US007713172B2

(12) United States Patent
Watterson et al.

(10) Patent No.: US 7,713,172 B2
(45) Date of Patent: May 11, 2010

(54) EXERCISE DEVICE WITH PROXIMITY SENSOR

(75) Inventors: Scott Watterson, Logan, UT (US); Darren C. Ashby, Richmond, UT (US)

(73) Assignee: Icon IP, Inc., Logan, UT (US)

( * ) Notice: Subject to any disclaimer, the term of this patent is extended or adjusted under 35 U.S.C. 154(b) by 88 days.

(21) Appl. No.: 12/251,222

(22) Filed: Oct. 14, 2008

(65) Prior Publication Data

US 2010/0093492 A1 Apr. 15, 2010

(51) Int. Cl.
*A63B 71/00* (2006.01)

(52) U.S. Cl. ..... 482/4; 482/8; 482/9; 482/51; 482/54

(58) Field of Classification Search ..... 482/1–9, 482/51, 54, 900–902; 434/247; 119/700
See application file for complete search history.

(56) References Cited

U.S. PATENT DOCUMENTS

| | | | | |
|---|---|---|---|---|
| 4,643,418 | A | 2/1987 | Bart | |
| 4,708,337 | A | 11/1987 | Shyu | |
| 5,184,295 | A | 2/1993 | Mann | |
| 5,242,339 | A | 9/1993 | Thornton | |
| 5,314,391 | A | 5/1994 | Potash et al. | |
| 5,368,532 | A | 11/1994 | Farnet | |
| 5,554,033 | A | 9/1996 | Bizzi et al. | |
| 5,857,939 | A | 1/1999 | Kaufman | |
| 6,066,075 | A | 5/2000 | Poulton | |
| 6,135,924 | A | 10/2000 | Gibbs et al. | |
| 6,409,633 | B1 * | 6/2002 | Abelbeck | 482/54 |
| 6,554,749 | B2 | 4/2003 | Lund et al. | |
| 6,582,342 | B2 | 6/2003 | Kaufman | |
| 6,682,461 | B2 | 1/2004 | Wang et al. | |
| 6,730,002 | B2 | 5/2004 | Hald et al. | |
| 7,156,776 | B2 | 1/2007 | Maser | |
| 7,507,187 | B2 * | 3/2009 | Dyer et al. | 482/54 |
| 2001/0051564 | A1 * | 12/2001 | Iund et al. | 482/54 |
| 2004/0171465 | A1 | 9/2004 | Hald | |
| 2006/0279294 | A1 | 12/2006 | Cehelnik | |
| 2007/0245612 | A1 | 10/2007 | Tresenfeld | |

OTHER PUBLICATIONS

International Search Report, International Application No. PCT/US2009/060552, mailed Dec. 4, 2009, 2 pages.
Written Opinion of the International Searching Authority, International Application No. PCT/US2009/060552, mailed Dec. 4, 2009, 5 pages.
Canterbury-Bankstown Express, "Idea Keeps Kids Safe," dated Jun. 8, 2009, 1 page.
One (1) DVD of "Move Safety Device for Treadmills" video, posted on YouTube, on information and belief, at least as early as Sep. 15, 2009, time 1:37.
Screen Shots from "Move Safety Device for Treadmills" video, posted on YouTube, on information and belief, at least as early as Sep. 15, 2009, 9 pages.

* cited by examiner

*Primary Examiner*—Glenn Richman
(74) *Attorney, Agent, or Firm*—Workman Nydegger

(57) ABSTRACT

An exercise device configured to sense and respond to objects in proximity to the exercise device is provided. The device includes a sensor configured to sense objects in proximity to the exercise device other than the user who is operating the exercise device. A console is in communication with the sensor that instructs components of the treadmill to provide, for example, an audible and/or visual response to the user of the exercise device, or to slow or stop the exercise device from moving. Sensors that are capable of sensing whether objects are within different spatial zones of proximity are disclosed. Multiple pre-defined and/or user-defined responses to objects detected in multiple corresponding spatial zones of proximity are also disclosed herein.

19 Claims, 9 Drawing Sheets

EXERCISE DEVICE WITH PROXIMITY SENSOR

BACKGROUND OF THE INVENTION

1. The Field of the Invention

The present disclosure relates to exercise devices. More particularly, this disclosure relates to exercise devices with sensors that sense objects surrounding an exercise device and provide a response to the sensed objects.

2. The Relevant Technology

Many people today exercise for recreation, diversion, and heath-related purposes. Many exercise activities require large areas to perform such as running, biking, rowing, etc. People wishing to exercise may not always have access to the large areas required to perform some exercises. Therefore, exercise devices have become a popular tool to assist users in performing exercises within confined spaces. Such devices may include treadmills, elliptical trainers, stair climbers, rowing machines, cross-country ski exercisers, gliders, and stationary bicycles.

Since exercise devices are often used in confined spaces, such as in a user's living space, in a gymnasium, or in other training facilities, other persons or objects are often present in the same general space as the exercise device. If foreign objects approach too close to an exercise device that is in use, the exercise device may be damaged, the exercising activity of a user may be interrupted, or the object may otherwise interfere with use of the exercise device.

BRIEF SUMMARY OF THE INVENTION

An exercise device configured to sense and respond to objects in proximity to the exercise device is provided. The exercise device may be a treadmill, a stationary bicycle, an elliptical trainer, a stair climber, a rowing machine, a cross-country ski exerciser, a weight training apparatus, or a glider, for example, although a variety of different exercise devices may be employed.

The exercise device is configured to sense and respond to objects in proximity to the exercise device. The device includes a sensor configured to sense objects in proximity to the exercise device. The sensor is configured to sense objects other than the user who is operating the exercise device. A console is provided that is in communication with the sensor. The console responds to signals from the sensor by providing, for example, an audible and/or visual response, e.g., a warning, to the user of the exercise device. Optionally, the console slows or stops the movement of the device.

In some applications, it may be desirable to provide multiple, tiered responses about an object that is approaching the exercise device. Thus, sensors that are capable of sensing whether objects are within different spatial zones of proximity are disclosed. For example, a sensor may sense whether an object is located in a zone between about 3 feet and about 6 feet from an exercise device or whether an object is located in another zone between about 0 feet and about 3 feet from an exercise device. The console associated with the exercise device may provide multiple different responses, such as a first response for objects located between the zone about 3 feet and about 6 feet from the exercise device and a second response for objects located in the zone between about 0 feet and about 3 feet from the exercise device.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

An exercise device configured to sense and respond to objects in proximity to the exercise device is provided. The exercise device may be a treadmill, a stationary bicycle, an elliptical trainer, a stair climber, a rowing machine, a cross-country ski exerciser, a weight training apparatus, or a glider or a variety of other exercise devices. The exercise device is configured to sense and respond to objects in proximity to the exercise device and includes a sensor configured to sense objects in proximity to the exercise device. The sensor is configured to sense objects other than the user who is operating the exercise device. A console is also provided that is in communication with the sensor and with various components of the exercise device. The console responds to objects sensed by the sensor by providing, for example, and audio/video response to the user of the exercise device.

In some applications, it may be desirable to provide multiple responses about an object that is approaching the exercise device. Thus, sensors that are capable of sensing whether objects are within different spatial zones of proximity are disclosed. For example, a sensor may sense whether an object is located in a zone between about 3 feet and about 6 feet from an exercise device or whether an object is located in a zone between about 0 feet and about 3 feet from an exercise device. A console that is associated with the exercise device may provide multiple different responses, such as a first response for objects located in a zone between about 3 feet and about 6 feet from the exercise device and a second response for objects located in a zone between about 0 feet and about 3 feet from the exercise device.

For example, a treadmill may be configured with a sensor to sense objects behind the treadmill and a console to provide a response to an object sensed by the sensor. The sensor may sense whether an object is within any one of multiple different spatial zones of proximity, and the console may provide a response based upon the spatial zone of proximity in which an object is sensed. A more detailed description of a treadmill with a sensor and a console will now be given with reference to the Figures.

Figure 1:
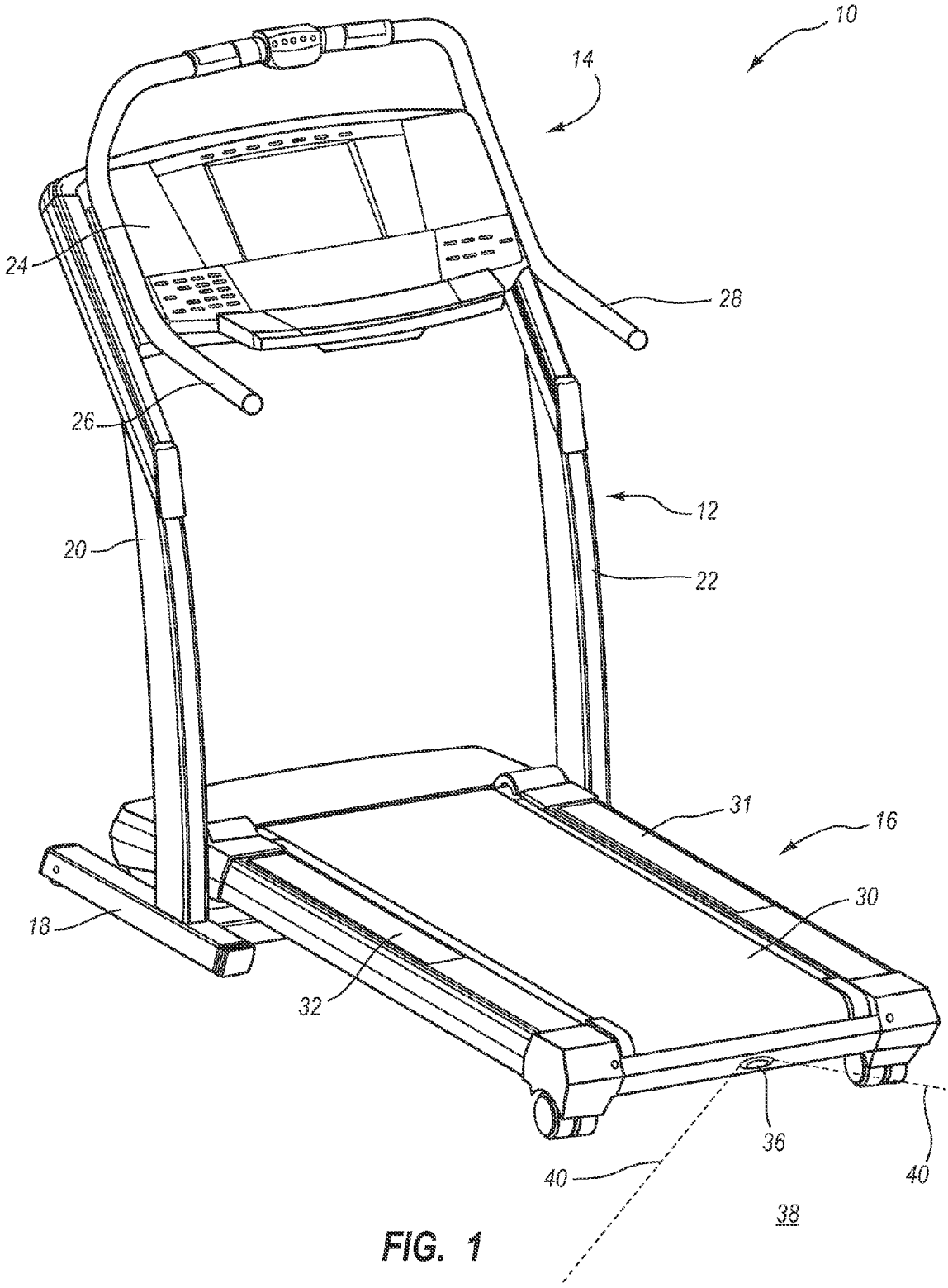
FIG. 1 illustrates a perspective view of a treadmill with a console and associated sensor; the illustrated sensor is shown as having a detection area behind the treadmill.

FIG. 1 illustrates a treadmill 10 that includes a frame 12, a console 14, and a tread base 16. Frame 12 of treadmill 10 comprises a support base 18 and vertical support members 20 and 22 that extend upwardly from support base 18. Frame 12 also includes a cross member 24 extending between vertical support members 20 and 22 and on which is attached the console 14. Handle bars 26 and 28 are mounted to the vertical support members 20 and 22. Tread base 16 of treadmill 10 comprises a frame, parallel rotating rollers mounted on the frame, endless belt 30 disposed about the rotating rollers, a motor mounted on the frame that drives the movement of endless belt 30, and platforms 32 and 34 mounted on the frame that extend alongside endless belt 30. Treadmill 10 is thus configured so that a user of treadmill 10 may control operation of treadmill 10 by interacting with console 14 while ambulating on endless belt 30.

Frame 12 of treadmill 10 is configured to provide support to console 14 and to tread base 16. Vertical support members 20 and 22 elevate cross member 24 and console 14 to a height at which a user may conveniently access and operate console 14. Handle bars 26 and 28 may also be provided so that a user of treadmill 10 may grasp handle bars 26 and 28 for support while ambulating on endless belt 30 of treadmill 10.

Tread base 16 of treadmill 10 provides a surface on which a user of treadmill 10 may exercise. Tread base 16 includes endless belt 30 that is moved by the operation of a motor. For example, the motor may move one of the parallel rollers so as to drive endless belt 30 such that a user may ambulate on endless belt 30. Platforms 32 and 34 provide a non-moving surface adjacent to endless belt 30 on which a user may stand without having to stop the movement of endless belt 30. Typically, endless belt 30 is driven around rollers between which endless belt 30 provides a relatively flat surface. The rollers may or may not form part of the motor that drives endless belt 30. The motor enables the speed of endless belt 30 to be adjusted so that a user may walk, jog, and/or run on endless belt 30. Means associated with tread base 16 are often provided to raise and lower the angle of tread base 16 relative to the ground on which treadmill 10 rests.

Console 14 of treadmill 10 includes a controller 102 (FIG. 5) that controls various operating parameters of treadmill 10. As further illustrated in FIG. 5, the controller 102 of console 14 communicates with the motor 100 that drives endless belt 30 and the means for adjusting the angle of tread base 16 so that the controller 102 may change the speed of endless belt 30 and/or the incline of tread base 16 before, during, or after the exercise of a user on treadmill 10. In addition, controller 102 may be configured to provide information about the exercise status of the user or about the operation of treadmill 10. Controller 102 may comprise a microcontroller, for example, and is operatively connected to one or more sensors 36, to the motor 100 that drives belt 14, and to various components of console 14, such as the user input devices and the audio and visual warning devices. Console 14 and the features of console 14 will be further described hereinafter with further reference to FIGS. 4 and 5.

Exercise devices, such as treadmill 10, are well known in the art, and one of skill in the art will recognize other configurations of treadmills that may be used with embodiments of the invention described herein. In addition, the present invention is not limited to use with treadmills and may also be practiced with any exercise device, such as elliptical trainers, stair climbers, rowing machines, cross-country ski exercisers, weight training apparatuses, gliders, and stationary bicycles, for example.

With continued reference to FIG. 1, treadmill 10 further comprises a sensor 36 that is coupled to tread base 16 and communicates with the controller 102. Sensor 36 is shown as having a detection zone 38 defined by dashed lines 40. Sensor 36 of treadmill 10 is configured to sense objects that may be behind a user of treadmill 10. Sensor 36 may be any type of sensor known in the art that is capable of detecting the presence of an object, such as a capacitance sensor, infrared sensor, laser distance measurement sensor, metal detector, photodetector, proximity sensor, thermal sensor, video camera, ultrasonic sensor, sonar sensor, radar sensor, or any combination thereof, for example. The operation of some sensors that may be used with the present invention will be further described with reference to FIG. 7.

Any number of sensors may be provided on treadmill 10 such that the sensors may sense objects to the sides, in front of, and/or behind treadmill 10. A global detection zone of treadmill 10 may depend upon the number and/or type of sensors employed in connection with the present invention. One of skill in the art will recognize that a detection zone may comprise a zone completely surrounding treadmill 10, or may comprise one or more discrete detection areas proximate to treadmill 10. Depending on a particular implementation, the detection zone of the sensor or sensors that are a associated with an exercise device may comprise any size and shape of an area proximate to the exercise device.

Figure 2:
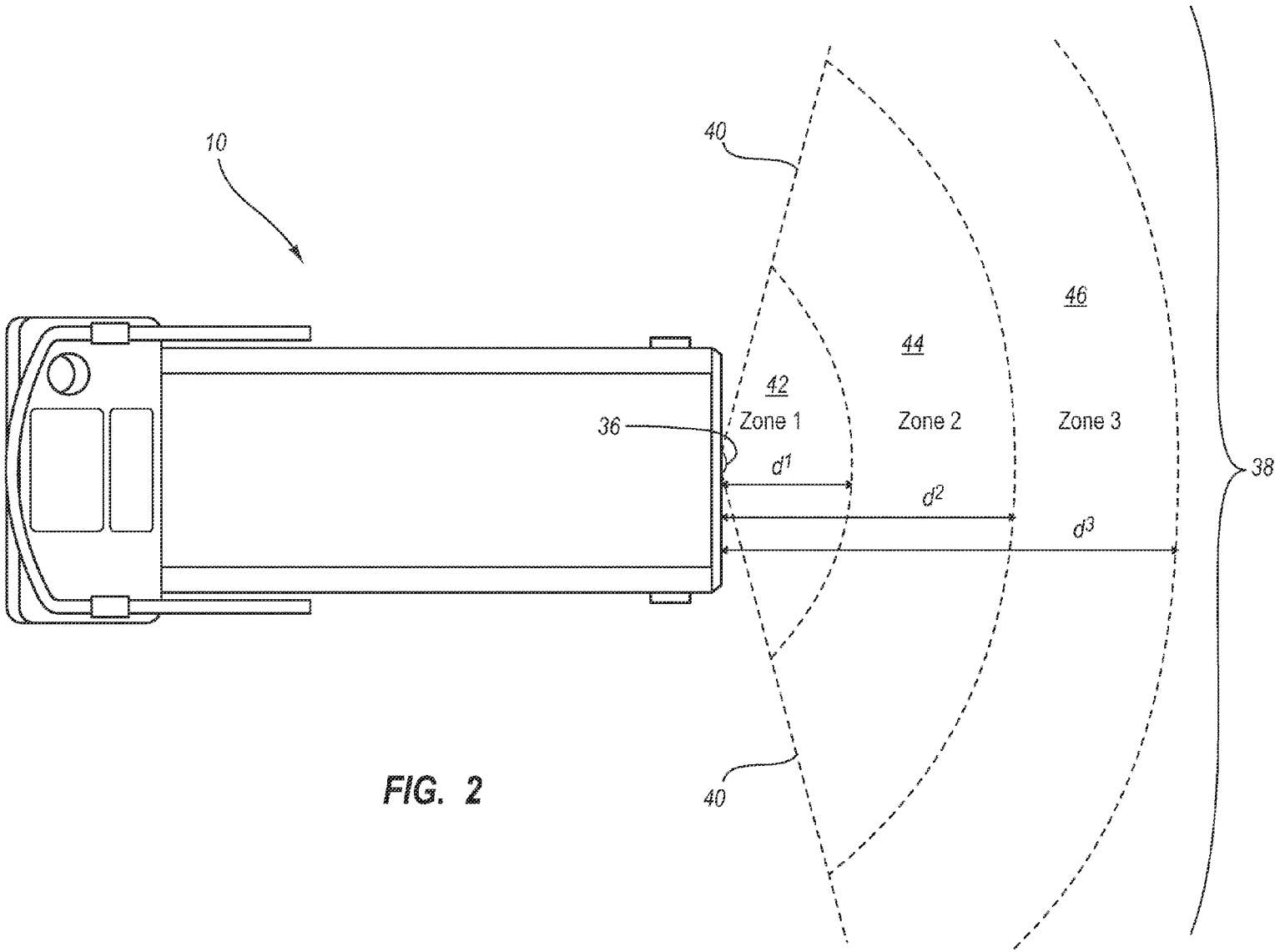
FIG. 2 illustrates different spatial zones of proximity relative to the exercise device of FIG. 1; the illustrated spatial zones of proximity are located at different distances from the exercise device.

FIG. 2 illustrates an overhead view of a treadmill 10 with a sensor 36. Sensor 36 has a detection zone 38 defined by dashed lines 40, which define a relatively conical shape projecting from sensor 36. Sensor 36 of treadmill 10 is configured to sense the distance of objects from treadmill 10. In addition, detection zone 38 comprises three spatial zones of proximity relative to treadmill 10. A first spatial zone 42 of proximity may be defined as the area within detection zone 38 between sensor 36 and a distance $d_1$ from sensor 36; a second spatial zone 44 of proximity may be defined as the area within detection zone 38 between a distance $d_1$ and a distance $d_2$ from sensor 36; and a third spatial zone 46 of proximity may be defined as the area within detection zone 38 between a distance $d_2$ and a distance $d_3$ from sensor 36.

Although sensor 36 is used as the reference point to define the spatial zones of proximity in FIG. 2, that any reference point associated with an exercise device may be used to define the spatial zones of proximity. Further, spatial zones of proximity need not be defined by distance from a reference point associated with an exercise device. For example, spatial zones of proximity may be defined by distance from an exercise device or associated reference point, direction from an exercise device or associated reference point, different detection zones of multiple sensors, elevation, etc. Although not shown, multiple spatial zones of proximity may also overlap.

Sensor 36 in FIG. 2 may provide information to console 14 of treadmill 10 regarding the zone in which an object is sensed so that console 14 may provide a response that is based on the zone in which an object is sensed. Additionally, sensor 36 may provide information about whether an object is approaching treadmill 10 or moving away from treadmill 10. For example, sensor 36 may first sense an object that is approaching treadmill 10 within the third spatial zone 46 of proximity. As the object approaches, sensor 36 may sense the object move from the third spatial zone of proximity 46 to the second spatial zone of proximity 44. Thus, sensor 36 may provide information that an object is approaching treadmill 10 to console 14 of treadmill 10. Conversely, sensor 36 may detect an object within the first spatial zone 42 of proximity. As the object moves away from treadmill 10, the object may move to the second spatial zone 44 of proximity. Sensor 36 may sense that the object moved from the first spatial zone 42 of proximity to the second spatial zone 44 of proximity and, thus, provide information that an object is moving away from treadmill 10 to console 14 of treadmill 10.

Figure 2A:
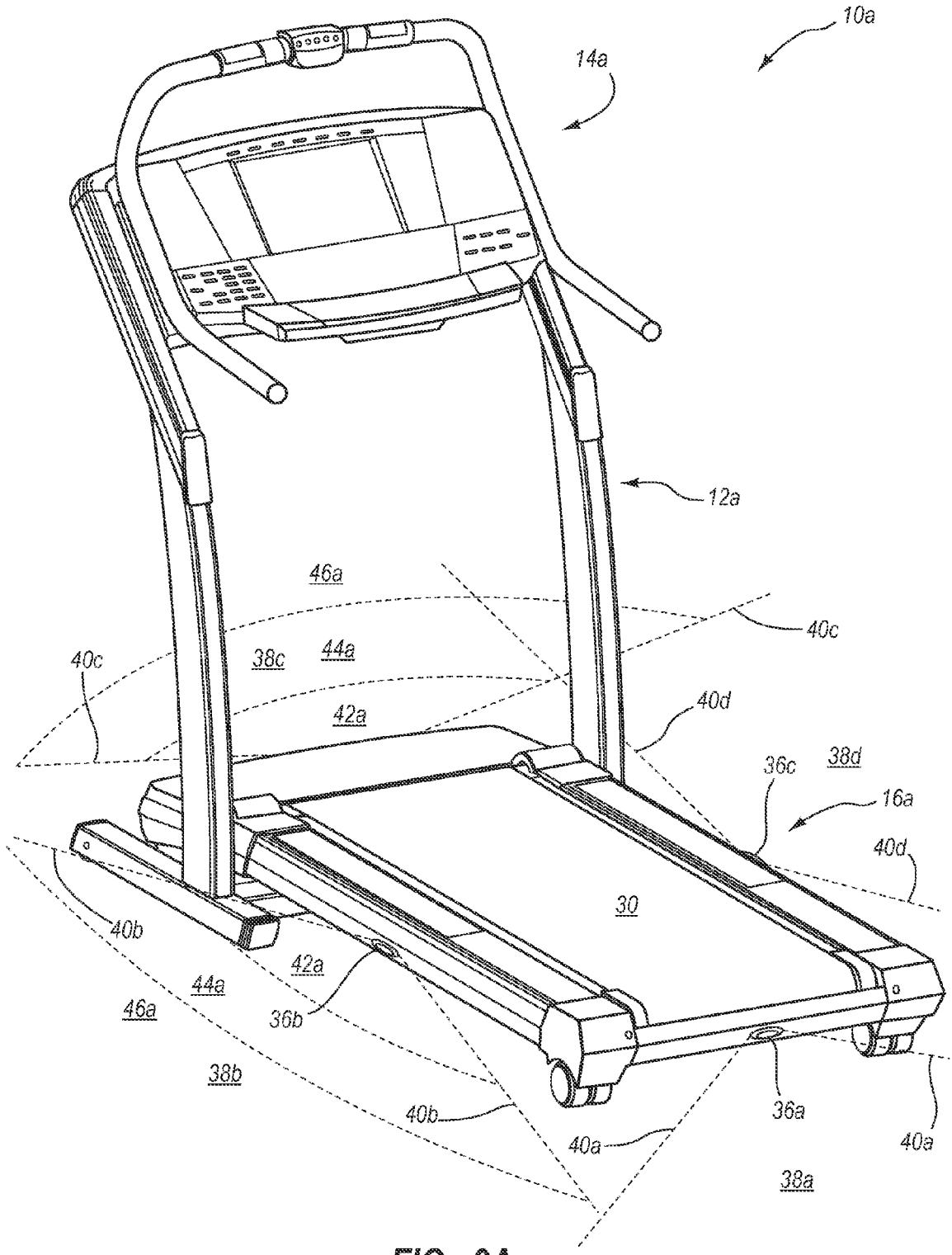
FIG. 2A illustrates different spatial zones of proximity relative to an alternative exercise device comprising multiple sensors configured to sense objects in multiple directions from the exercise device.

FIG. 2A shows an embodiment of an exercise device 10*a* that comprises multiple sensors. Like exercise device 10 of FIG. 1, exercise device 10*a* includes a sensor 36*a* that is configured to detect objects behind exercise device 10*a*. Sensor 36*a* has a detection zone 38*a* that is defined by dashed lines 40*a*. In addition, exercise device 10*a* includes a left sensor 36*b*, front sensor (not shown), and right sensor 36*c*. Left sensor 36*b* has a detection zone 38*b* projecting to the left of exercise device 10*a* that is defined by dashed lines 40*b*. The front sensor has a detection zone 38*c* projecting in front of exercise device 10*a* that is defined by dashed lines 40*c*. The right sensor has a detection zone 38*d* projecting to the right of exercise device 10*a* that is defined by dashed lines 40*d*.

The sensors of exercise device 10*a* may be configured to sense an object that approaches exercise device 10*a* from any direction. Thus, a global or overall detection area for exercise device 10*a* may be an area that circumscribes exercise device 10*a*. As one of skill in the art will recognize from this description and from the drawings, one or more detection zones of one or more sensors may define any area of any shape around an exercise device.

FIG. 2A additionally illustrates multiple spatial zones of proximity that extend across the detection zones 38*a-d* of the sensors of exercise device 10*a*. A first spatial zone 42*a* of proximity forms a circle around exercise device 10*a*. The outer circumference of first spatial zone 42*a* of proximity may be a pre-defined or a user-defined distance from the center of exercise device 10*a*; in some embodiments the outer circumference of first spatial zone 42*a* of proximity may be about 3 feet from the center of exercise device 10*a*. A second spatial zone 44*a* of proximity forms a ring around exercise device 10*a* that has an inner circumference defined by the outer circumference of first spatial zone 42*a* of proximity. An outer circumference of second spatial zone 44*a* of proximity may be pre-defined or user-defined and in some embodiments may be about 6 feet from the center of exercise device 10*a*. A third spatial zone 46*a* of proximity forms a ring around exercise device 10*a* that has an inner circumference defined by the outer circumference of second spatial zone 44*a* of proximity. An outer circumference of third spatial zone 46*a* of proximity may be pre-defined or user-defined and in some embodiments may be about 9 feet from the center of exercise device 10*a*.

Although FIG. 2A illustrates spatial zones of proximity that extend across multiple detection zones, a spatial zone of proximity may comprise an area within only one detection zone. The spatial zones of proximity described with reference to FIGS. 2 and 2A have been circular or rounded in shape. However, spatial zones of proximity are not limited to any particular size, shape, or configuration.

Figure 3:
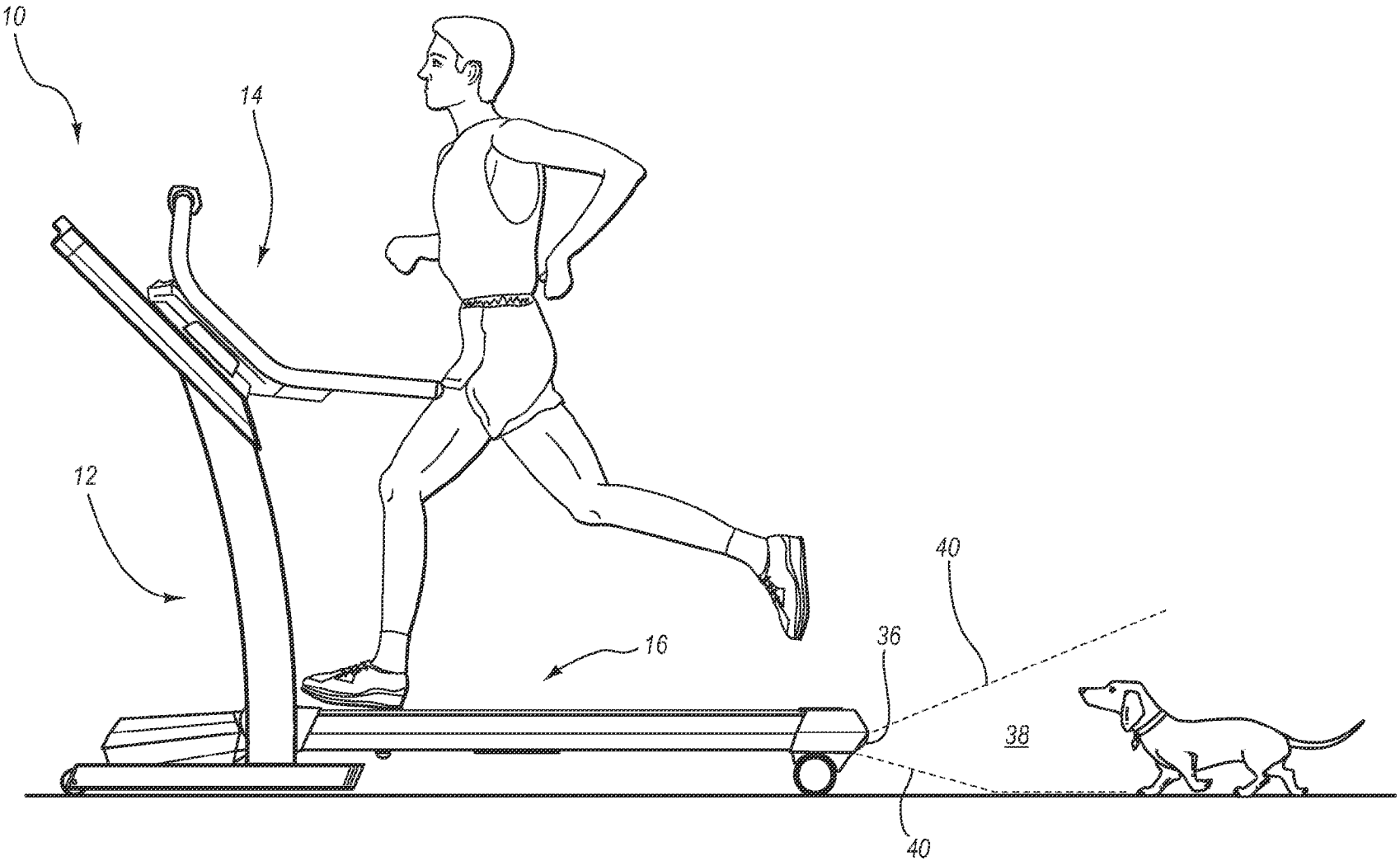
FIG. 3 illustrates a situation in which a foreign object is approaching a user on the treadmill of FIG. 1; the illustrated foreign object is located within the detection area behind the treadmill.

Now with reference to FIG. 3, treadmill 10 of FIG. 1 is shown with a user ambulating thereon. FIG. 3 also illustrates a foreign object, e.g., a pet such as a dog, approaching treadmill 10. The dog is shown within detection zone 38 of sensor 36. A foreign object may unexpectedly interrupt the exercise of the user on treadmill 10, may damage treadmill 10, or may otherwise interfere with the operation of treadmill 10 by the user. Sensor 36 may detect the foreign object in its detection zone 38 and inform other components of treadmill 10 about the presence of the foreign object. For example, in FIG. 3, sensor 36 would detect the presence of a foreign object within the detection zone 38 and send information about the presence of a foreign object to console 14 of treadmill 10. Console 14 could then inform the user about the presence of the foreign object sensed by the sensor and/or provide other responses.

Figure 3A:
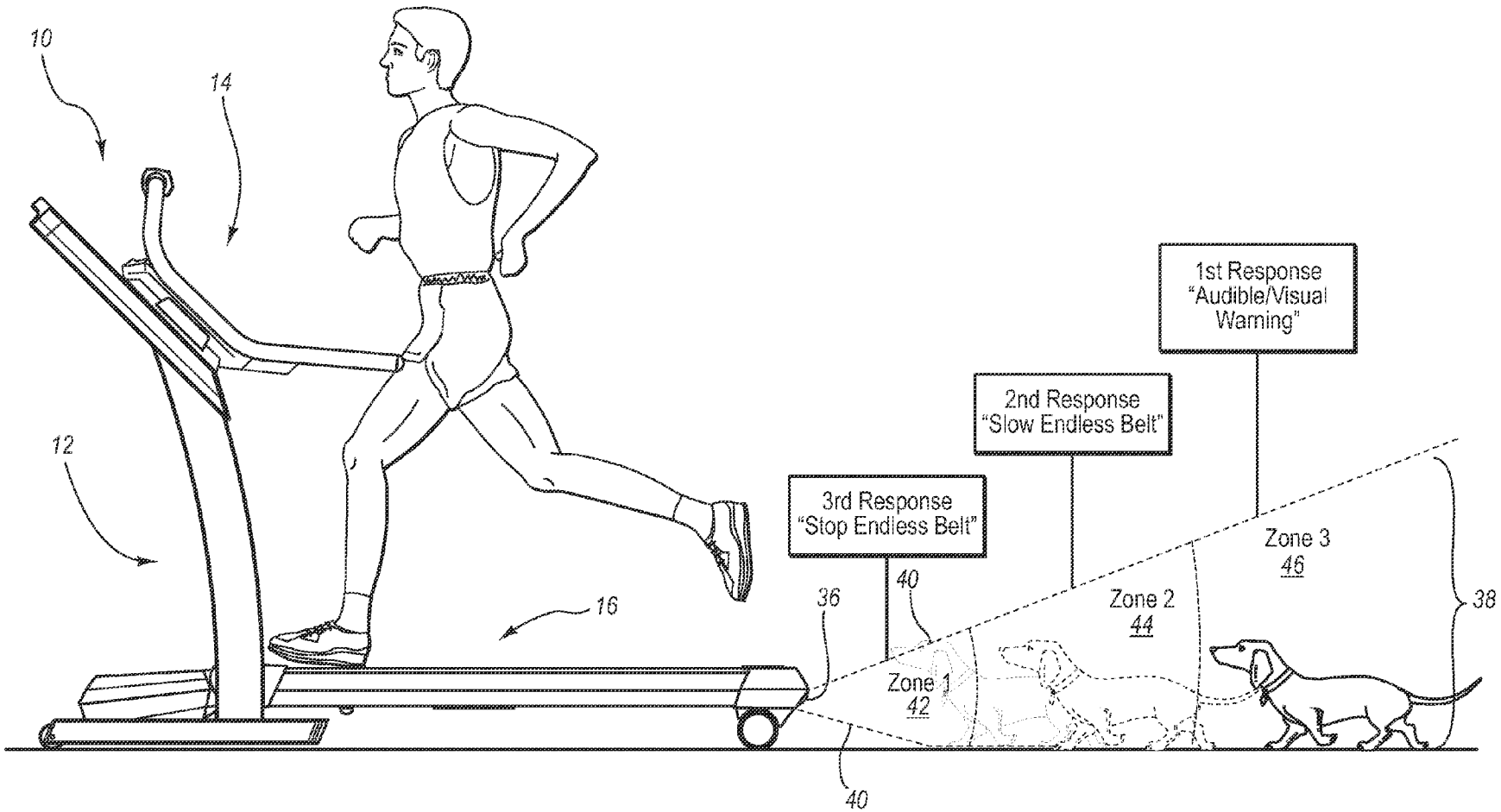
FIG. 3A illustrates possible responses of the treadmill of FIG. 1 as an object approaches the treadmill and moves into different zones of proximity.

FIG. 3A illustrates one possible response scheme to a foreign object that approaches an exercise device of the present invention. FIG. 3A shows the exercise device of FIGS. 1 and 2 with associated spatial zones of proximity 42, 44, and 46. A dog is shown within third spatial zone of proximity 46, and phantom outlines of the dog are shown in first spatial zone of proximity 42 and second spatial zone of proximity 44. The phantom outlines of the dog are to illustrate possible future locations of the dog.

Sensor 36 of exercise device 10 may sense the dog within third spatial zone 46 of proximity. When the dog is in third spatial zone 46 of proximity, exercise device 10 may produce a first response such as an audible warning to the user of exercise device 10 that an object is sensed close to the exercise device. If the dog moves closer to exercise device 10 such that the dog is within second spatial zone 44 of proximity, exercise device 10 may produce a second response such as a slowing of the endless belt of exercise device 10. If the dog moves even closer to exercise device 10 such that the dog is within first spatial zone 42 of proximity, exercise device 10 may produce a third response such as stopping the endless belt of exercise device 10. Thus, different responses may be provided by an exercise device based upon a spatial zone of proximity in which an object is detected.

Figure 4:
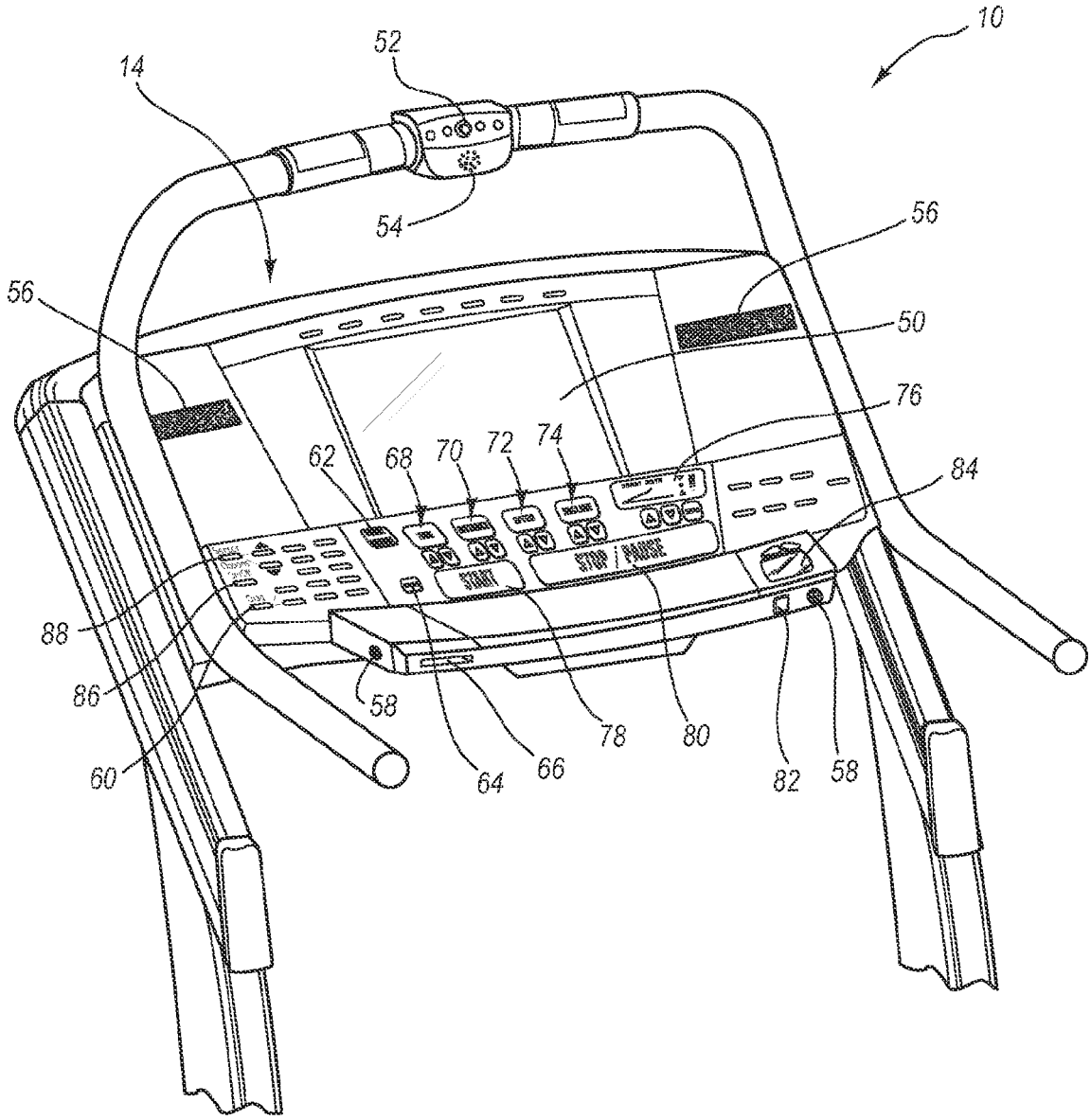
FIG. 4 illustrates the console of the exercise device of FIG. 1 that includes user inputs, displays, speakers, and other components; the console is configured to respond to an object in proximity to the exercise device.
Figure 5:
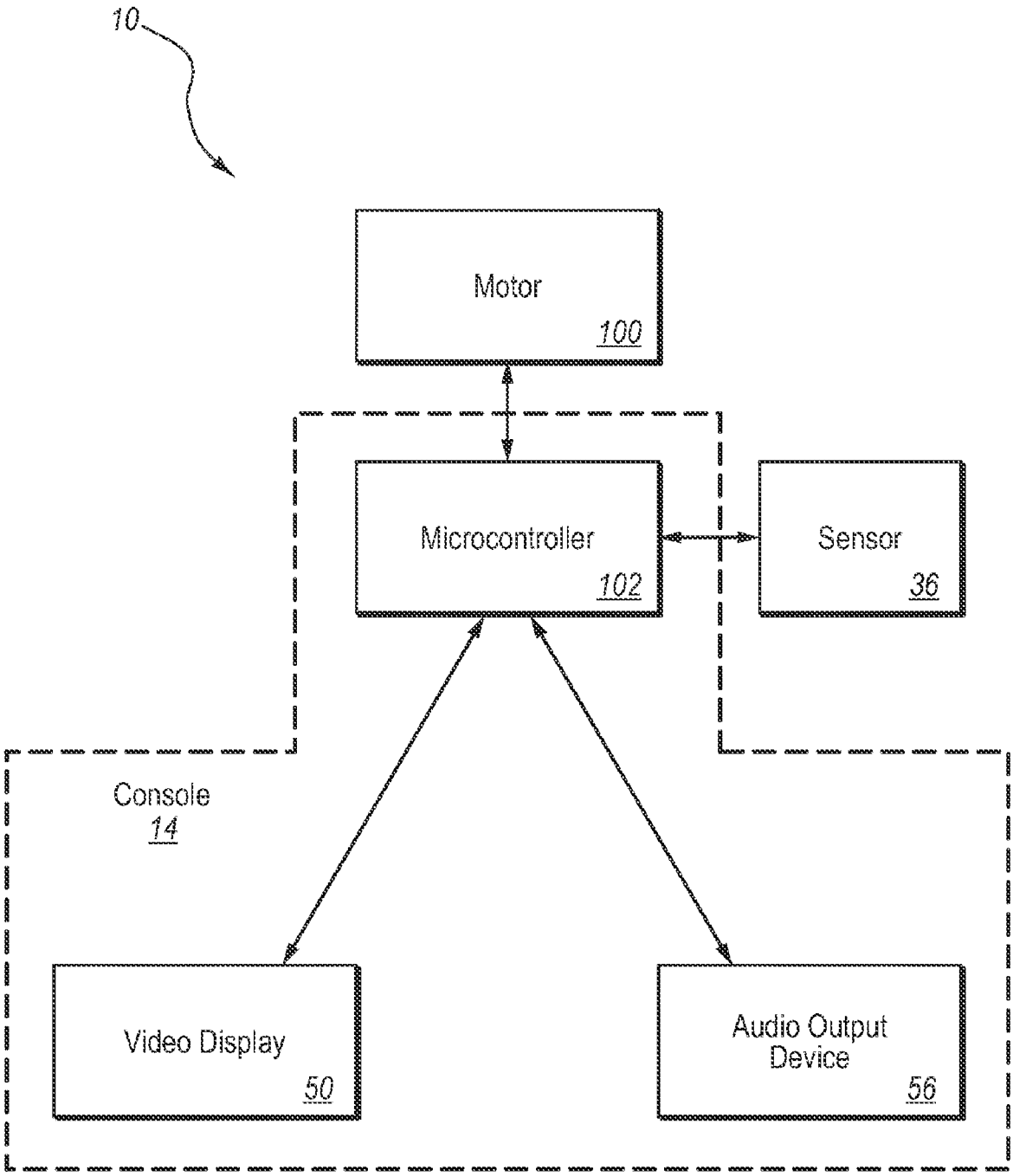
FIG. 5 illustrates a wiring diagram for various components of the exercise device of FIG. 1, showing that the sensor may communicate with the console in order to trigger a response to an object sensed by the sensor.

FIGS. 4 and 5 illustrate console 14 for use with exercise device 10. Console 14 is adapted for use with the other components of treadmill 10, but the basic functions and operation of console 14 may be adapted for use with any exercise device.

As illustrated in FIGS. 4 and 5, console 14 includes a controller 102, e.g., a microcontroller, and a variety of components operatively coupled to and communicating with controller 102, including, for example: video display 50, video input device 52, audio input device 54, audio output device 56 (e.g., speakers), I/O ports 58, diagnostics control 60, manual override control 62, scaling control 64, dead-man's key receiver 66, time controls 68, distance controls 70, speed controls 72 incline controls 74, heart rate monitor 76, start control 78, stop/pause control 80, wireless port 82, and trackpad pointing device 84. It will be appreciated, however, that the every control and device provided on console 14 is not required for practice of the invention. It will also be appreciated that additional controls, components, and/or devices may be provided on console 14 consistent with the invention.

Motor 100 is also coupled to and communicates with controller 102 of console 14 such that console 14 can stop, start, speed up and slow down endless belt 30 in accordance with the present invention.

The components of the console described and claimed herein may or may not be contiguously oriented and may or may not be housed in the same housing of console 14 shown in FIG. 4, but may still perform the functions described herein as being performed by console 14, and are thus part of the console of the present invention as claimed herein. Thus, the configuration of console 14 shown in the attached drawings is exemplary in nature only and not limiting of the invention. For example, a console as claimed in the present invention may include a microcontroller oriented in a housing such as shown at console 14, but may include an alarm, speakers display, or other components thereof, for example, that are coupled to a treadbase and/or another portion of the frame of a treadmill.

Video display 50 coupled to and communicating with controller 102 provides visual information to a user of a treadmill. Visual information may include exercise program information, exercise status information (e.g., heart rate, calories burned, speed, time, incline, etc.), object proximity information, and/or other information. Audio output device 56 coupled to and communicating with controller 102 provides audible information to a user of a treadmill; such information may include information about the exercise program or exercise machine, information about the proximity of objects to the treadmill, and/or other information.

As will be further described with reference to FIG. 5, console 14 may modify the operation of associated treadmill 10. The controls of console 14 (e.g., manual override control 62, scaling control 64, time controls 68, distance controls 70, speed controls 72, incline controls 74, heart rate controls 76, start control 78, stop/pause control 80) communicate with motor 100 and other components of the associated treadmill 10 in order to provide a user with a means to control the speed of the endless belt and/or the incline of the tread base, the duration of an exercise program, etc. One of skill in the art will readily recognize the many functionalities and operation characteristics of a number of exercise devices that may be used consistent with the present disclosure.

FIG. 5 illustrates a wiring-diagram that illustrates a possible relationship between various components of exercise device 10, including sensor 36. The exercise device of FIG. 5 includes motor 100 in communication with controller 102, which communicates with sensor 36. Controller 102 further communicates with video display 50, audio output device 56 and other components of console 14 that are illustrated in FIG. 4, for example.

Motor 100 controls the operation and speed of an endless belt. A second motor communicating with and operatively coupled to controller 102 controls the incline of the tread base, for example. Controller 102 communicates with motor 100 and may send motor 100 commands, e.g., to start or stop operation of the endless belt, increase or decrease the speed of the endless belt, etc. and may command the second motor to raise or lower the inclination of the tread base.

As further shown in FIGS. 4 and 5, console 14 includes input means, such as a user input pad, communicating with controller 102 to thereby enable the user to send commands regarding the operations and functions of exercise device 10 to controller 102. Upon receipt of commands from the user through console 14, controller 102 send commands to motor 100 and/or other components reflecting the desired operations or functions of exercise device 10.

Sensor 36 may be a sensor as described previously in this disclosure that senses objects in proximity to an exercise device. Sensor 36 may send information regarding sensed objects to controller 102. This information may include, for example, information about whether objects are in proximity to the exercise device, information about the distance of objects from exercise device 10, information about the spatial zone of proximity in which an object is sensed, and/or information about whether an object is approaching or moving away from exercise device 10. Upon receipt of information about objects in proximity to exercise device 10, controller 102 issues appropriate responses to motor 100, other components of console 14 or other components of exercise device 10.

For example, controller 102 may stop or slow down endless belt 30 by sending commands to motor 100 in response to an object sensed by sensor 36. Additionally, controller 102 may send a response to video display 50 and/or audio output device 56 of console 14.

As described, sensor 36 may provide information to controller 102 about a spatial zone of proximity in which an object is sensed. Alternatively, controller 102 may determine a spatial zone of proximity in which an object is sensed based upon information provided from sensor 36 regarding the distance of the object from the exercise device and/or based upon which sensor of multiple sensors sensed the object. One or more spatial zones of proximity may be pre-defined by the sensor and/or controller 102 or may be user-defined spatial zones of proximity.

For example, console 14 may include buttons and/or a user input pad and related circuitry coupled to controller 102 for a user to define one or more spatial zones of proximity. Thus, for example, a first spatial zone of proximity may be pre-defined or user-defined as between about 0 feet and about 3 feet from exercise device 10, a second zone of proximity may be pre-defined or user defined as between about 3 feet and about 6 feet from exercise device 10, and a third spatial zone of proximity may be pre-defined or user-defined as between about 6 feet and about 9 feet from exercise device 10.

In one embodiment, the zones of spatial proximity and/or the responses provided by the exercise device are selectively defined by the user. Due to limited space behind exercise device 10, a user of exercise device 10 may wish to define a first spatial zone of proximity to between about 0 feet and about 1 feet behind exercise device 10, a second spatial zone of proximity to between about 1 feet to about 2.5 feet behind exercise device 10, and a third spatial zone of proximity to between about 2.5 feet to about 5 feet behind exercise device 10. Any definition scheme consistent with the present disclosure may be used to pre-define or user-define one or more spatial zones of proximity.

Furthermore, responses to objects sensed in proximity to exercise device 10 may be pre-defined or user-defined responses. Console 14 may include means coupled to controller 102 whereby a user may define one or more responses to objects sensed in proximity to exercise device 10, such as a user input pad communicating with controller 102, for example. Multiple pre-defined and/or user-defined responses may correspond to the multiple pre-defined and/or user-defined spatial zones of proximity. Thus, a particular response may be given based upon the spatial zone of proximity in which an object is sensed. Examples of responses include, but are not limited to, audible responses, visual responses, tactile responses, electric responses, adjustment of the operating parameters of an exercise device, or combinations thereof. Tactile and/or electric responses might include responses provided through handlebars, handgrips and/or electrodes mounted on frame 12, for example.

A user may define responses such that the speed of endless belt 30 reduces as an object nears exercise device 10. Alternatively, a user may define responses such that the speed of endless belt 30 is unaltered as an object approaches exercise device 10, but that an audible warning is sounded. Any definition scheme consistent with the present disclosure may be used to pre-define or user-define one or more responses for use when responding to objects within particular spatial zones of proximity of exercise device 10.

Figure 6:
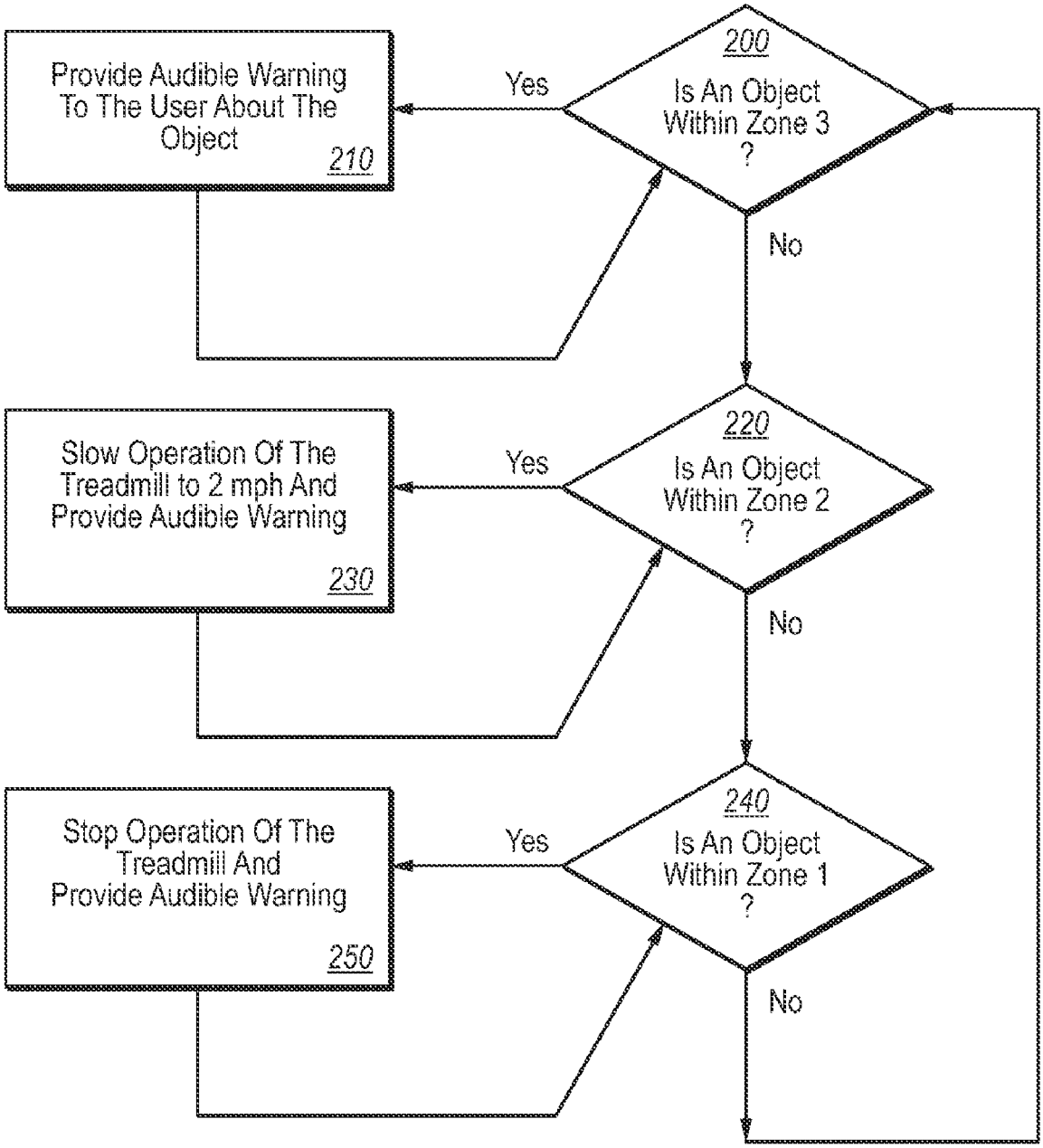
FIG. 6 illustrates a decision-tree diagram showing one possible operation of the exercise of FIG. 1. The illustrated diagram shows that the exercise device may check for an object within a first spatial zone of proximity, then a second spatial zone of proximity, and then a third spatial zone of proximity, providing responses to objects sensed within the different spatial zones of proximity.

Referring now to FIG. 6, an example of a method for sensing and responding to objects in proximity to an exercise device will be described. FIG. 6 illustrates one possible decision tree for providing responses to a user based upon the spatial zone of proximity in which an object may be sensed. Many variations of the described example may be used consistent with the present disclosure.

In a first step 200, an exercise device 10 senses whether an object is within a third spatial zone of proximity, which may be defined as between about 6 feet and about 9 feet from the exercise device, for example. If an object is sensed within the third spatial zone of proximity, then the exercise device provides a first response 210, which may be an audible warning to the user of the exercise device. The audible warning may include a pre-recorded statement that an object is near the exercise device, an alarm, a buzzer, a siren, or any other audible signal. Exercise device 10 may be configured to continuously sense and warn the user of the proximity of the object within the third spatial zone of proximity as long as the object remains in the third spatial zone of proximity.

If no object is sensed within the third spatial zone of proximity then, in a second step 220, exercise device 10 senses whether an object is within a second spatial zone of proximity, which may be defined as between about 3 feet and about 6 feet from exercise device 10. If an object is sensed within the second spatial zone of proximity then the exercise device provides a second response 230, which may be a reduction of the speed of endless belt 30 and production of an audible and/or visual warning to the user, for example. A second warning may be more urgent than the first warning due to, for example, closer proximity of an object to exercise device 10. For example, a more urgent audible warning may be provided. A visual warning may also be provided such as a flashing light, a textual warning, a video view of the sensed object from a video camera associated with sensor 36, or any other visual warning. For example, exercise device 10 may be configured to continuously sense and warn the user of the proximity of the object within the second spatial zone of proximity as long as the object remains in the second spatial zone of proximity.

If no object is sensed within the second spatial zone of proximity then, in a third step 240, exercise device 10 senses whether an object is within a first spatial zone of proximity, which may be defined as between about 0 feet and about 3 feet from exercise device 10, for example. If an object is sensed within the first spatial zone of proximity, then the exercise device provides a third response 250, which may be cessation of operation of the endless belt, e.g., by turning off motor 100, and/or production of an audible/visual warning to the user. Exercise device 10 may be configured to continuously sense and warn the user of the proximity of the object within the first spatial zone of proximity as long as the object remains in the first spatial zone of proximity.

The steps for sensing and responding to objects may be performed such that preference is given to the spatial zones of proximity and their associated responses that are nearest to the exercise device. Alternatively, no preference may be given to any of the spatial zones of proximity. One of skill in the art will recognize a wide variety or procedures that may be used to provide responses to objects sensed in proximity to exercise devices herein disclosed.

Figure 7A:
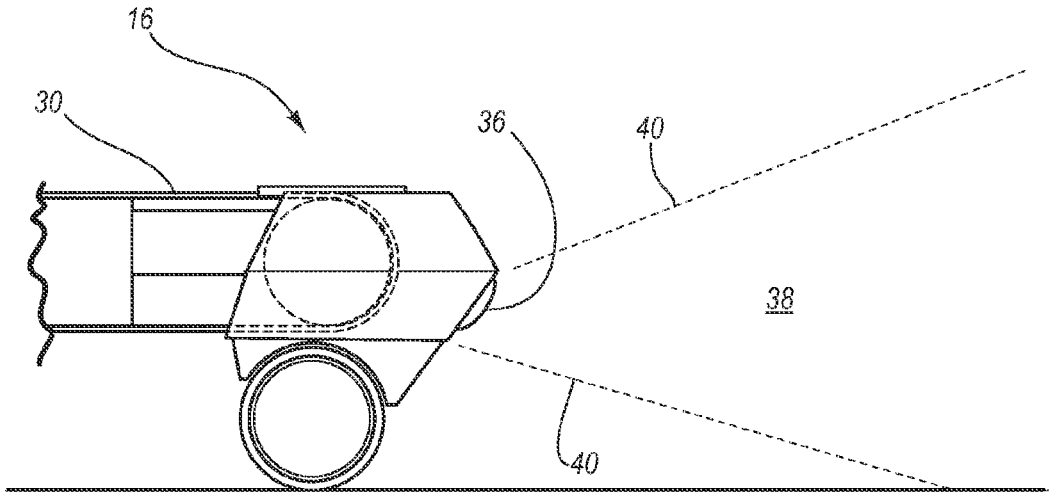
FIGS. 7A-B illustrate a close-up view of a sensor that may be used with an exercise device to sense the presence of a foreign object adjacent the exercise device.
Figure 7B:
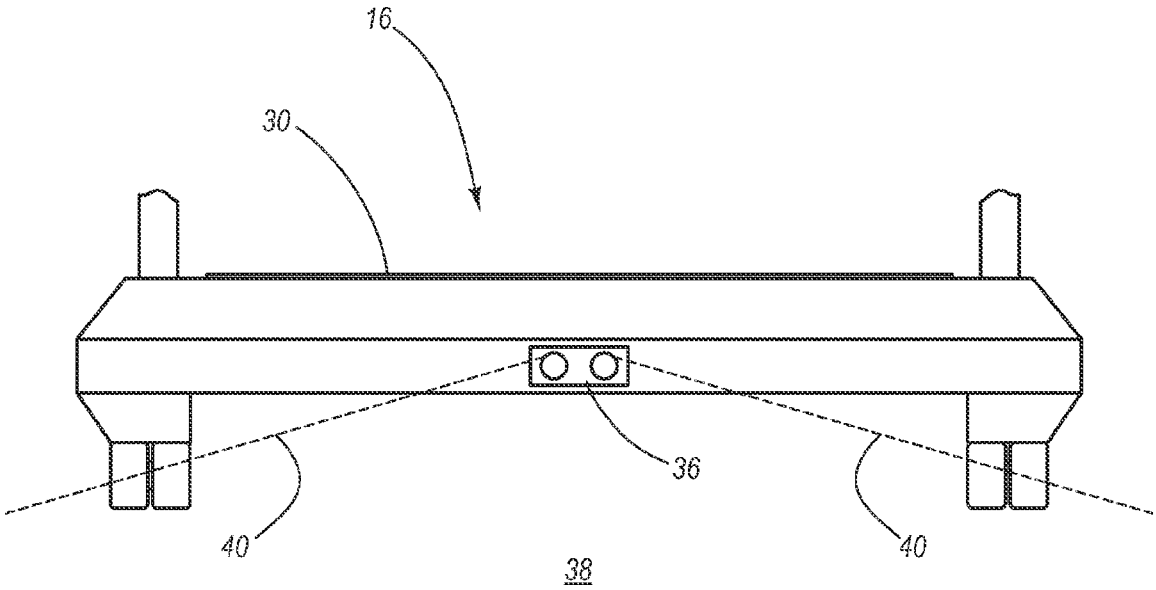

With attention now to FIG. 7, a sensor 36 is illustrated that may be used with exercise device 10. For example, sensor 36 may be provided on the rear of treadmill 10 near the underside of endless belt 30. Sensor 36 is positioned such that sensor 36 is directed towards the area external to exercise device 10 on which it is placed. In such a configuration the user of exercise device 10 will not be sensed by sensor 36.

Sensor 36 of FIG. 7 is a proximity sensor of a type well known in the art. Sensor 36 emits an infrared beam of electromagnetic radiation. If an object is within a detection zone of sensor 36 then the infrared beam of radiation will be reflected by the object back to sensor 36. Sensor 36 may then detect changes to the reflected infrared beam of radiation in order to determine the location of the object. Proximity sensors are only one type of sensor that may be used to sense objects in proximity to exercise devices, and one of skill in the art will recognize a wide variety of sensors that may be used in light of the present disclosure, for example, capacitance sensors, infrared sensors, laser distance measurement sensors, metal detectors, motion detectors, photodetectors, proximity sensors, thermal sensors, video cameras, ultrasonic sensors, sonar sensors, radar sensors, or any combination thereof.

Endless belt 30 is an example of a moveable element that is part of an exercise mechanism, such as a treadmill. Other examples of moveable elements include the rotating pedals and/or wheel of an exercise bike, the foot supports of an elliptical exercise device, the stairs or pedals of a stepping device, the handlebars of an elliptical exerciser or strider, and a variety of other elements that move in connection with use of an exercise mechanism by a user. As described herein, console 14 is in operative communication with sensor 36 and with belt 30 and is configured to provide a response to objects sensed by sensor 36 that are in proximity to the exercise device 10.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An exercise device configured to sense objects in proximity to the exercise device, the exercise device comprising:

an exercise mechanism comprising a movable element for movement in performance of exercise by a user;

a sensor coupled to the exercise mechanism and configured to sense objects in proximity to the exercise mechanism other than the user of the exercise mechanism, wherein the sensor can differentiate between a plurality of spatial zones of proximity; and a console in operative communication with the sensor and the movable element, wherein the console is configured to provide a response to objects sensed by the sensor that are in proximity to the exercise mechanism, wherein the console is configured to provide a first response to objects sensed by the sensor in a first spatial zone of proximity of the plurality of spatial zones of proximity and to provide a second response to objects sensed in a second spatial zone of proximity of the plurality of spatial zones of proximity.

2. The exercise device of claim 1, wherein the exercise mechanism comprises a treadmill and the moveable element comprises a treadmill belt.

3. The exercise device of claim 1, wherein the sensor comprises a capacitance sensor, an infrared sensor, a laser distance measurement sensor, a metal detector, a motion detector, a photodetector, a proximity sensor, a thermal sensor, a video camera, an ultrasonic senor, a sonar sensor, a radar sensor, or any combination thereof.

4. The exercise device of claim 1, wherein the exercise device comprises at least two sensors configured to sense objects in proximity to the exercise device other than the user of the exercise device.

5. The exercise device of claim 1, wherein at least one of the first response and the second response comprises a user-defined response.

6. The exercise device of claim 1, wherein at least one of the plurality of spatial zones of proximity comprises a user-defined spatial zone of proximity.

7. The exercise device of claim 1, wherein the first of the plurality of spatial zones of proximity comprises an area between about 6 feet and about 9 feet from the sensor, the second of the plurality of spatial zones of proximity comprises an area between about 3 feet and about 6 feet from the sensor, and a third of the plurality of spatial zones of proximity comprises an area between about 0 feet and about 3 feet from the sensor.

8. The exercise device of claim 1, wherein at least one of the first response and the second response comprises an audible response, a visual response, a tactile response, an electric response, an adjustment of an operating parameter of the exercise device, or any combination thereof.

9. The exercise device of claim 1, wherein at least one of the plurality of spatial zones of proximity is generally elliptical in shape.

10. The exercise device of claim 1, wherein at least one of the plurality of spatial zones of proximity is generally conical in shape.

11. The exercise device of claim 1, wherein at least one of the plurality of spatial zones of proximity is generally rectangular in shape.

12. A method for responding to objects in proximity to an exercise device, the method comprising:

providing an exercise device comprising:

an exercise mechanism comprising a movable element for movement in performance of exercise by a user, and a sensor coupled to the exercise mechanism and configured to sense objects in proximity to the exercise mechanism other than the user of the exercise mechanism; and a console that controls functions of the exercise device, the console being in communication with the sensor;

sensing the proximity of objects, other than the user, in the area around the exercise device with the sensor, wherein the area around the exercise device comprises a plurality of spatial zones of proximity;

providing a first response if an object is sensed within a first spatial zone of proximity of the plurality of spatial zones of proximity; and providing a second response if an object is sensed within a second spatial zone of proximity of the plurality of spatial zones of proximity.

13. The method of claim 12, wherein at least one of the first response and the second response comprises, an audible response, a visual response, a tactile response, an electric response, an adjustment of an operating parameter of the exercise device, or any combination thereof.

14. The method of claim 12, wherein the first response comprises an audible response and the second response comprises adjusting an operating parameter of the exercise device.

15. The method of claim 12, wherein the first response and the second response are different.

16. An exercise device configured to sense and respond to objects in proximity to the exercise device, the exercise device comprising:

a frame;

a motor coupled to the frame;

a movable element operatively coupled to the frame for movement in performance of exercise by a user;

a console communicating with the motor; and a sensor communicating with the console, wherein the sensor is configured to sense objects in proximity to the exercise device, other than the user of the exercise device, and wherein the sensor can differentiate between a plurality of spatial zones of proximity, and wherein the console is configured to provide a first response to objects sensed by the sensor in a first of the plurality of spatial zones of proximity, and wherein the console is configured to provide a second response to objects sensed in a second of the plurality of spatial zones of proximity.

17. The exercise device of claim 16, wherein the console is configured to provide a third response to objects sensed by the sensor in a third spatial zone of proximity.

18. The exercise device of claim 16, wherein at least one of the first response and the second response comprises, an audible response, a visual response, a tactile response, an electric response, an adjustment of an operating parameter of the exercise device, or any combination thereof.

19. A treadmill configured to sense and respond to objects in proximity to the treadmill, the treadmill comprising:

a frame;

a motor coupled to the frame;

an endless belt coupled to the frame, wherein the endless belt is configured such that a user may ambulate thereon, and wherein the motor is configured to control the rotational speed of the endless belt;

a console coupled to the frame and communicating with the motor, the console being configured to control at least one operating parameter of the treadmill, wherein the at least one operating parameter relates to the rotational speed of the endless belt; and a proximity sensor coupled to the frame and communicating with the console, wherein the proximity sensor is configured to sense the proximity of objects, other than the user ambulating on the endless belt, in relation to the treadmill, and wherein the proximity sensor is adapted to differentiate between a plurality of spatial zones of proximity, wherein the treadmill is configured to provide a first warning to the user of the treadmill when an object is sensed by the sensor in a first spatial zone of proximity, the treadmill being further configured to provide a second, more urgent warning when an object is sensed by the sensor in a second spatial zone of proximity, the treadmill further configured to slow or stop the rotation of the endless belt when an object is sensed by the sensor in a third spatial zone of proximity.

* * * * *

UNITED STATES PATENT AND TRADEMARK OFFICE

CERTIFICATE OF CORRECTION

PATENT NO. : 7,713,172 B2
APPLICATION NO. : 12/251222
DATED : May 11, 2010
INVENTOR(S) : Watterson et al.

It is certified that error appears in the above-identified patent and that said Letters Patent is hereby corrected as shown below:

Column 3
Line 35, change "34" to --31--
Line 52, change "34" to --31--

Column 6
Line 64, delete "the"

Signed and Sealed this
Fourth Day of January, 2011

David J. Kappos
*Director of the United States Patent and Trademark Office*